US010899424B2

(12) United States Patent
Biery, II et al.

(10) Patent No.: US 10,899,424 B2
(45) Date of Patent: Jan. 26, 2021

(54) MARINE POWER STEERING SYSTEM

(71) Applicant: STEERING SOLUTIONS IP HOLDING CORPORATION, Saginaw, MI (US)

(72) Inventors: Addney T. Biery, II, Clio, MI (US); John E. Weber, Pinconning, MI (US); Christopher R. Douglas, Saginaw, MI (US)

(73) Assignee: Steering Solutions IP Holding Corporation, Saginaw, MI (US)

( * ) Notice: Subject to any disclaimer, the term of this patent is extended or adjusted under 35 U.S.C. 154(b) by 7 days.

(21) Appl. No.: 15/941,448

(22) Filed: Mar. 30, 2018

(65) Prior Publication Data

US 2018/0281915 A1 Oct. 4, 2018

Related U.S. Application Data

(60) Provisional application No. 62/479,887, filed on Mar. 31, 2017.

(51) Int. Cl.
*B63H 25/02* (2006.01)

(52) U.S. Cl.
CPC ..... *B63H 25/02* (2013.01); *B63H 2025/022* (2013.01)

(58) Field of Classification Search
CPC ..... B63H 21/21; B63H 21/213; B63H 2021/216; B63H 21/22; B63H 25/02; B63H 2025/022
See application file for complete search history.

(56) References Cited

U.S. PATENT DOCUMENTS 6,113,444 A * 9/2000 Ritger ..... B63H 21/265 440/61 S
2005/0252433 A1* 11/2005 Gai ..... B63H 25/02 114/144 R
2010/0116190 A1* 5/2010 Ito ..... B63H 20/12 114/144 RE

* cited by examiner

*Primary Examiner* — Andrew Polay
(74) *Attorney, Agent, or Firm* — Dickinson Wright PLLC

(57) ABSTRACT

A marine power steering system includes a first steering input device and a second steering input device. The first steering input device includes a first steering sensor that provides a first signal indicative of at least one of a torque and an angular position of a first steering wheel. The first steering input device further includes a controller arranged to receive the first signal. The second steering input device includes a second steering sensor that provides a second signal indicative of at least one of a torque and an angular position of a second steering wheel to the controller.

14 Claims, 1 Drawing Sheet

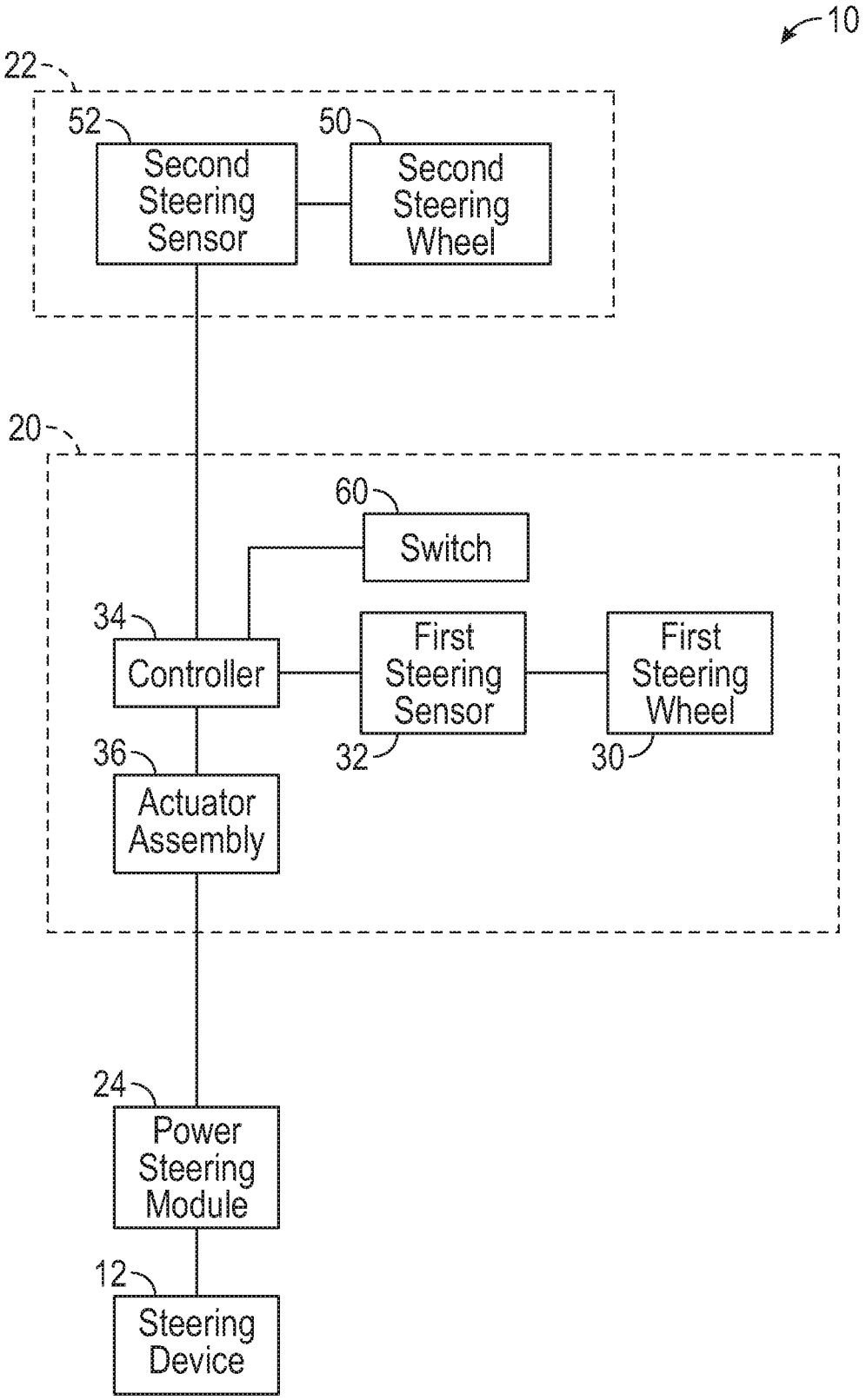
10
22
52
Second Steering Sensor
50
Second Steering Wheel
20
60
Switch
34
Controller
First Steering Sensor
First Steering Wheel
32
30
36
Actuator Assembly
24
Power Steering Module
12
Steering Device

MARINE POWER STEERING SYSTEM

CROSS-REFERENCES TO RELATED APPLICATIONS

This patent application claims priority to U.S. Provisional Patent Application Ser. No. 62/479,887, filed Mar. 31, 2017, which is incorporated herein by reference in its entirety.

BACKGROUND

The present disclosure relates to a marine power steering system.

A marine vehicle may be equipped with a steering system having a primary steering wheel connected to an engine, a rudder, or other steering mechanism. Some marine vehicles are provided with an additional steering wheel that is located at a different location than the primary steering wheel. The additional steering wheel may be mechanically connected to the primary steering wheel through a push/pull cable or hydraulic pump/cylinder. This configuration may lead to a steering system that is both wasteful and lacking in good steering feel as the additional steering wheel may be back driven while the marine vehicle is being steered from the primary steering wheel.

SUMMARY

According to an embodiment of the present disclosure, a marine power steering system is provided. The marine power steering system includes a first steering input device, a second steering input device, and a power steering module. The second steering input device is spaced apart from and is in communication with the first steering input device. The power steering module is in communication with the first steering input device. Responsive to an input provided to at least one of the first steering input device and the second steering input device, the other of the at least one of the first steering input device and the second steering input device is inhibited from operating and the power steering module is arranged to move a steering device.

According to another embodiment of the present disclosure, a marine power steering system is provided. The marine power steering system includes a first steering input device and a second steering input device. The first steering input device includes a first steering sensor that provides a first signal indicative of at least one of a torque and an angular position of a first steering wheel. The first steering input device further includes a controller arranged to receive the first signal. The second steering input device includes a second steering sensor that provides a second signal indicative of at least one of a torque and an angular position of a second steering wheel to the controller.

According to yet another embodiment of the present disclosure, a power steering system is provided. The power steering system includes a first steering sensor, a second steering sensor, and a controller. The first steering sensor provides a first signal indicative of at least one of a torque and an angular position of a first steering wheel of a first steering input device. The second steering sensor provides a second signal indicative of at least one of a torque and an angular position of a second steering wheel of a second steering input device. The controller is in communication with the first steering sensor, the second steering sensor, and an actuator assembly. The controller is programmed to operate the actuator assembly in response to receiving at least one of the first signal or the second signal. The controller is also programmed to inhibit operation of at least one of the first steering input device and the second input device.

These and other advantages and features will become more apparent from the following description taken in conjunction with the drawings.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawing in which:

FIG. 1 is a schematic view of a marine power steering system of the present disclosure.

DETAILED DESCRIPTION

Referring now to the FIGURE, where the present disclosure will be described with reference to specific embodiments, without limiting same, it is to be understood that the disclosed embodiments are merely illustrative examples of the present disclosure that may be embodied in various and alternative forms. The FIGURE is not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Referring to FIG. 1, a marine power steering system 10 may be provided with a marine vessel such as a boat. The marine power steering system 10 is operatively connected to a steering device 12 such as a rudder or a propulsion system. The propulsion system may be an outboard motor, an outboard motor having a rudder, or the like. The marine power steering system 10 is configured to pivot, rotate, or otherwise move the outboard motor or the rudder to steer the marine vessel.

The marine power steering system 10 includes a first helm 20, a second helm 22, and a power steering module 24.

The first helm 20 is provided with a first steering input device that includes a first steering wheel 30 and a first steering sensor 32. The first helm 20 is also provided with a controller 34 and an actuator assembly 36. The first steering wheel 30 is connected to a steering shaft that extends into a steering column or housing.

The first steering sensor 32 may be configured as a rotational position sensor, an angular position sensor, a torque sensor, or the like. The first steering sensor 32 is arranged to monitor or measure a torque applied to or an angular/rotational position of the steering shaft and/or first steering wheel 30. The first steering sensor 32 is arranged to provide a first signal indicative of a torque applied to the steering shaft and/or the first steering wheel 30 or an angular/rotational position of the steering shaft and/or the first steering wheel 30 to the controller 34, in response to actuation of the first steering wheel 30.

The second helm 22 is spaced apart from the first helm 20 and is in communication with the power steering module 24 through the controller 34 of the first helm 20. The second helm 22 enables the marine vessel operator to steer the marine vessel while not being located at the first helm 20.

The second helm 22 is provided with a second steering input device that includes a second steering wheel 50 and a second steering sensor 52. The second steering wheel 50 is connected to a steering shaft that extends into a steering column. The second steering input device is in communication with the first steering input device, through a wireless or wire connection. While at least the second steering input device of the second helm 22 is operated, the marine power steering system 10 is at least partially operated as a steer by wire system.

The second steering sensor 52 may be configured as a rotational position sensor, an angular position sensor, a torque sensor, or the like. The second steering sensor 52 is arranged to monitor or measure a torque to or an angular/rotational position of the steering shaft and/or second steering wheel 50. The second steering sensor 52 is arranged to provide a second signal indicative of a torque applied to the steering shaft and/or the second steering wheel 50 or an angular/rotational position of the steering shaft and/or the second steering wheel 50 to the controller 34, in response to actuation of the second steering wheel 50.

The controller 34 is provided with input communication channels that are arranged to receive the first signal from the first steering sensor 32 of the first steering input device of the first helm 20 and the second signal from the second steering sensor 52 of the second steering input device of the second helm 22. The controller 34 is provided with output communication channels that are arranged to provide signals or commands from the first steering input device of the first helm 20 and/or the second steering input device of the second helm 22 to the actuator assembly 36 or to the power steering module 24 to move, pivot, or turn the steering device 12.

The controller 34 includes at least one processor, microprocessor, or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 34 to provide the signals or commands to the actuator assembly 36 or the power steering module 24 to move the steering device 12 in response to the signal provided by at least one of the first steering sensor 32 or the second steering sensor 52.

The controller 34 is programmed to inhibit operation of the first steering input device of the first helm 20, responsive to operation of the second steering input device of the second helm 22 (e.g. the controller 34 receiving the second signal from the second steering sensor 52 of the second helm 22). This feature "locks out" the first steering input device of the first helm 20 while the second steering input device of the second helm 22 is being operated.

The controller 34 is programmed to inhibit operation of the second steering input device of the second helm 22, responsive to operation of the first steering input device of the first helm 20 (e.g. the controller 34 receiving the first signal from the first steering sensor 32 of the first helm 20). This feature "locks out" the second steering input device of the second helm 22 while the first steering input device of the first helm 20 is being operated.

The actuator assembly 36 is in communication with the controller 34 and is in communication with or is operatively connected to the power steering module 24. The controller 34 may be integrated with the actuator assembly 36 and may be provided with the first helm 20. In at least one embodiment, the actuator assembly 36 and the controller 34 may be spaced apart from the first helm 20 and disposed within or proximate a transom well or an interior portion of the hull.

The actuator assembly 36 may include an electric motor, a hydraulic motor, an electromechanical unit, or the like that is arranged to provide an input to the power steering module 24. The power steering module 24 moves, pivots, or turns the steering device 12, responsive to rotation or actuation of the first steering input device of the first helm 20 and/or of the second steering input device of the second helm 22.

The power steering module 24 may be arranged as a hydraulic system, an electric system, or electrohydraulic system that is operatively connected to the first helm 20 and the steering device 12.

In at least one embodiment, the power steering module 24 may include a hydraulic pressure transducer that is operatively connected to at least one of a hydraulic pressure line and a hydraulic return line. The hydraulic pressure line and the hydraulic return line are operatively connected to an actuator cylinder, a push rod, or the like that is operatively connected to the steering device 12 or a steering linkage/rack and pinion steering system that is operatively connected to the steering device 12.

In at least one embodiment, the power steering module 24 may include an electric drive motor having a plurality of electrical leads such as an electrical supply line, an electrical return line, and other input lines. The other input lines may be force data lines, pressure data lines, or vessel speed data lines that are all provided to the controller 34. The electrical leads and other input lines may be in communication with an actuator cylinder, a push rod, a mechanical, hydraulic, or electrical actuator proximate the steering device 12 or at a steering linkage or rack and pinion steering system that is operatively connected to the steering device 12.

In at least one embodiment, the power steering module 24 may include a mechanical unit that pushes/pulls, torques, or twists a cable assembly that is operatively connected to the steering device 12. The mechanical unit includes an input that is operatively connected to the actuator assembly 36 and an output that is operatively connected to the cable assembly. Responsive to rotation or actuation of the first steering input device of the first helm 20 and/or of the second steering input device of the second helm 22, the mechanical unit is actuated and pushes/pulls, rotates, or applies a torque to the cable assembly to pivot the steering device 12.

In at least one embodiment, the power steering module 24 may include an output device operatively connected to the steering device 12. The output device may be an electric motor, electric actuator, or gear assembly that is in communication with actuator assembly 36 or may be directly in communication with the controller 34. The output device is arranged to move, pivot, or turn the steering device 12 responsive to rotation or actuation of the first steering input device of the first helm 20 or of the second steering input device of the second helm 22.

In at least one embodiment, a switch 60 (e.g. a three way switch) may be provided with the first helm 20 and/or the second helm 22. The switch 60 is in communication with the controller 34 and is arranged to selectively enable or disable either the first steering input device of the first helm 20 or the second steering input device of the second helm 22. The switch 60 is movable between a first position, a second position, and a third position.

The first steering input device of the first helm 20 is inhibited from operation and the second steering input device of the second helm 22 is enabled to operate, while the switch 60 is in a first position. The first steering sensor 32 is inhibited from providing the first signal to the controller 34 or the controller 34 ignores or is inhibited from receiving the first signal, while the switch 60 is in the first position. The second steering sensor 52 is enabled to provide the second signal to the controller 34 or the controller 34 is enabled to receive the second signal, while the switch is in a first position.

The first steering input device of the first helm 20 is enabled to operate and the second steering input device of the second helm 22 is inhibited from operation, while the switch 60 is in a second position. The first steering sensor 32 is enabled to provide the first signal to the controller 34 or the controller 34 is enabled to receive the first signal, while the switch is in the second position. The second steering sensor 52 is inhibited from providing the second signal to the controller 34 or the controller 34 ignores or does not receive the second signal, while the switch is in a second position.

The controller 34 places the first steering input device of the first helm 20 and the second steering input device of the second helm 22 in a standby mode, while the switch 60 is in the third position. The controller 34 awaits for an input to be provided to the first steering input device of the first helm 20 or the second steering input device of the second helm 22 and inhibits operation of the second steering input device that does not receive an input. The controller 34 inhibits the second steering input device of the second helm 22 from operating while the switch 60 is in the third position, responsive to an input provided to the first steering input device of the first helm 20. The controller 34 inhibits the first steering input device of the first helm 20 from operating while the switch 60 is in the third position, responsive to an input provided to the second steering input device of the second helm 22.

The inhibiting of operation of the first steering input device of the first helm 20 by the controller 34, while the second steering input device of the second helm 22 is operated, prevents the first steering input device of the first helm 20 from being back driven, thereby reducing the amount of force required to steer the marine vessel.

The inhibiting of operation of the second steering input device of the second helm 22 by the controller 34, while the first steering input device of the first helm 20 is operated, prevents the second steering input device of the second helm 22 from being back driven, thereby reducing the amount of force required to steer the marine vessel.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description.

Having thus described the present disclosure, it is claimed:

1. A marine power steering system, comprising:

a first steering input device;

a second steering input device spaced apart from and in communication with the first steering input device;

a power steering module that includes an electric drive motor in communication with an electrical actuator operatively connected to a steering device, the power steering module being in further communication with the first steering input device;

a controller that, in response to an input provided to at least one of the first steering input device and the second steering input device, inhibit the other of the at least one of the first steering input device and the second steering input device from operating, wherein the power steering module is arranged to move the steering device, and a switch in communication with the controller, the switch being moveable between a first position, a second position, and a third position, wherein:

the first steering input device is inhibited from operation, while the switch is in the first position, the second steering input device is inhibited from operation, while the switch is in the second position; and the controller waits for input to provide to the first steering input device or the second steering input device, while the switch is in the third position.

2. The marine power steering system of claim 1, wherein responsive to the input provided to the first steering input device, the second steering input device is inhibited from operating.

3. The marine power steering system of claim 1, wherein responsive to the input provided to the second steering input device, the first steering input device is inhibited from operating.

4. The marine power steering system of claim 1, wherein the first steering input device includes:

a first steering sensor provides a first signal indicative of a torque and an angular position of a first steering wheel.

5. The marine power steering system of claim 4, wherein the second steering input device includes:

a second steering sensor provides a second signal indicative of a torque and an angular position of a second steering wheel.

6. The marine power steering system of claim 5, wherein the first steering input device is in communication with the controller programmed to, in response to at least one of the first signal and the second signal, operate the power steering module to move the steering device.

7. A marine power steering system, comprising:

a first steering input device includes:

a first steering sensor that provides a first signal indicative of at least one of a torque and an angular position of a first steering wheel, and a controller arranged to receive the first signal;

a second steering input device includes:

a second steering sensor that provides a second signal indicative of at least one of a torque and an angular position of a second steering wheel to the controller; and a power steering module that includes an electric drive motor in communication with an electrical actuator assembly operatively connected to a steering device, the power steering module being arranged to move a steering device a switch in communication with the controller, the switch being moveable between a first position, a second position, and a third position, wherein:

the first steering input device is inhibited from operation, while the switch is in the first position;

the second steering input device is inhibited from operation, while the switch is in the second position; and the controller waits for input to provide to the first steering input device or the second steering input device, while the switch is in the third position.

8. The marine power steering system of claim 7, wherein the controller is programmed to, in response to receiving the first signal, inhibit operation of the second steering input device.

9. The marine power steering system of claim 7, wherein the controller is programmed to, in response to receiving the second signal, inhibit operation of the first steering input device.

10. The marine power steering system of claim 7, wherein the electric actuator assembly is in communication with the controller.

11. The marine power steering system of claim 10, wherein the controller is programmed to, in response to receiving at least one of the first signal and the second signal, operate at least one of the electric actuator assembly and the power steering module to move the steering device.

12. A power steering system, comprising:

a first steering sensor that provides a first signal indicative of at least one of a torque and an angular position of a first steering wheel of a first steering input device;

a second steering sensor that provides a second signal indicative of at least one of a torque and an angular position of a second steering wheel of a second steering input device;

a power steering module that includes an electric drive motor in communication with an electric actuator operatively connected to a steering device; and a controller in communication with the first steering sensor, the second steering sensor, and the electrical actuator assembly, the controller programmed to:

operate the actuator assembly in response to receiving at least one of the first signal or the second signal, inhibit operation of at least one of the first steering input device and the second input device a switch in communication with the controller, the switch being arranged to selectively enable the first steering input device and the second steering input device, wherein the switch is further movable between a first position, a second position, and a third position, and wherein:

the first steering input device is inhibited from operation, while the switch is in the first position;

the second steering input device is inhibited from operation, while the switch is in the second position; and the controller waits for input to provide to the first steering input device or the second steering input device, while the switch is in the third position.

13. The marine power steering system of claim 1, wherein the first steering input device includes:

a first steering sensor provides a first signal indicative of one of a torque and an angular position of a first steering wheel.

14. The marine power steering system of claim 13, wherein the second steering input device includes:

a second steering sensor provides a second signal indicative of one of a torque and an angular position of a second steering wheel.

* * * * *